US010418698B2

(12) United States Patent
Lee

(10) Patent No.: US 10,418,698 B2
(45) Date of Patent: Sep. 17, 2019

(54) OMNIDIRECTIONAL ANTENNA USING ROTATION BODY

(71) Applicant: HCTM CO., LTD., Icheon-si (KR)

(72) Inventor: Seungjae Lee, Suwon-si (KR)

(73) Assignee: HCTM CO., LTD., Icheon-si (KR)

( * ) Notice: Subject to any disclaimer, the term of this patent is extended or adjusted under 35 U.S.C. 154(b) by 0 days.

(21) Appl. No.: 15/559,038

(22) PCT Filed: Mar. 16, 2016

(86) PCT No.: PCT/KR2016/002626

§ 371 (c)(1),
(2) Date: Sep. 16, 2017

(87) PCT Pub. No.: WO2016/148496

PCT Pub. Date: Sep. 22, 2016

(65) Prior Publication Data

US 2018/0097282 A1 Apr. 5, 2018

(30) Foreign Application Priority Data

Mar. 16, 2015 (KR) ..... 10-2015-0036193

(51) Int. Cl.

| | |
|---|---|
| ***H01Q 3/02*** | (2006.01) |
| ***H01Q 1/38*** | (2006.01) |
| ***H01Q 1/08*** | (2006.01) |
| ***H01Q 19/18*** | (2006.01) |
| ***H01Q 1/28*** | (2006.01) |
| ***H01Q 25/00*** | (2006.01) |
| *H01Q 9/42* | (2006.01) |

(52) U.S. Cl.

CPC ..... *H01Q 1/38* (2013.01); *H01Q 1/08* (2013.01); *H01Q 1/283* (2013.01); *H01Q 3/02* (2013.01); *H01Q 19/18* (2013.01); *H01Q 25/005* (2013.01); *H01Q 9/42* (2013.01)

(58) Field of Classification Search

CPC ..... H01Q 1/125; H01Q 3/08; H01Q 1/28; H01Q 1/286; H01Q 1/281

USPC ..... 343/882, 705, 763, 708

See application file for complete search history.

(56) References Cited

U.S. PATENT DOCUMENTS 5,745,081 A * 4/1998 Brown ..... H01Q 1/28 343/705

2017/0210463 A1* 7/2017 Koessick ..... B64C 27/10

FOREIGN PATENT DOCUMENTS

| | | |
|---|---|---|
| JP | 05-218723 | 8/1993 |
| JP | 2000-151246 | 5/2000 |
| KR | 10-1997-0003965 | 3/1997 |
| KR | 10-0142668 | 8/1998 |
| KR | 10-2009-0104595 | 10/2009 |

OTHER PUBLICATIONS

International Search Report dated Jun. 24, 2016 for PCT/KR2016/002626, and its English translation.

* cited by examiner

*Primary Examiner* — Dameon E Levi
*Assistant Examiner* — Collin Dawkins

(57) ABSTRACT

An omni-directional antenna using a rotator is disclosed. The omni-directional antenna is installed on the rotator having at least one rotation blade, and includes an antenna carrier unit disposed on at least one of top and bottom surfaces of the blade, and an antenna pattern unit formed on the antenna carrier unit.

13 Claims, 5 Drawing Sheets

OMNIDIRECTIONAL ANTENNA USING ROTATION BODY

CROSS-REFERENCE TO RELATED APPLICATION(S)

This application is a National Stage Entry of International Application No. PCT/KR2016/002626, filed on Mar. 16, 2016, which claims the benefit of and priority to Korean Patent Application No. 10-2015-0036193, filed on Mar. 16, 2015, which are herein incorporated by reference in their entirety.

TECHNICAL FIELD

The present disclosure relates to relates to an omni-directional antenna using a rotator, and more particularly, to an omni-directional antenna using a rotator, the structure of which is improved to have omni-directionality close to a circle, inherent to an omni-directional antenna, by installing an antenna to at least one rotation blade installed in the rotator and thus allowing the rotation blade and the antenna to rotate together, to thereby increase the radiation efficiency of the antenna, improve polarization characteristics, and thus increase the transmission and reception efficiency of a drone.

BACKGROUND ART

In general, an antenna is a device designed to radiate waves efficiently in a space, or propagate a signal efficiently by receiving waves.

An antenna is fixedly installed to transmit or receive a signal in a predetermined frequency band used for military communication facilities, or to transmit or receive waves used for home appliances such as a TV or a radio. In the fixed state, the antenna transmits and receives signals by resonance in a predetermined frequency band according to a purpose that the antenna serves.

Antennas have recently been developed for mobile devices, black boxes, and so on, which transmit and receive Global Positioning System (GPS) signals, images, voice, and data signals, while moving.

As described above, an antenna capable of transmitting multi-band signals during movement has been developed and used.

Further, in the case where a device is operated by rotating blades, such as a helicopter, an aircraft or drone with propellers, a wind power plant, or a windmill, an antenna is installed for transmitting and receiving various signals configured for monitoring, control, and data according to various purposes.

However, a rotator with blades may interfere with waves transmitted and received from and at an antenna by the blades, thereby decreasing transmission and reception efficiency. Particularly, if the blades are formed of a metal, the metal itself has the property of reflecting waves. The resulting interference occurs to signals transmitted and received by rotation, thereby rapidly decreasing reception efficiency.

Among the rotators, a drone with propellers takes off, flies, and lands by remote control of signals transmitted and received through an antenna. If a signal is blocked or becomes weak during flight, the drone is not controllable and thus collides with an adjacent object or falls down.

Moreover, in the drone with propellers, thrust force and lift force are generated by rotation of propeller blades. As the body of the drone is formed of a metal robust against an external environment, such as aluminum or titanium, the metal interferes with signals transmitted and received from and at the antenna, thus degrading transmission and reception performance and making transmission and reception efficiency fluctuate according to altitudes. As a result, the drone is not controllable.

DISCLOSURE

Technical Problem

Accordingly, to overcome limitations and disadvantages of the related art, an object of the present disclosure is to provide an omni-directional antenna using a rotator, the structure of which is improved to have omni-directionality close to a circle, inherent to an omni-directional antenna, by installing an antenna to at least one rotation blade installed in the rotator and thus allowing the rotation blade and the antenna to rotate together, to thereby increase the radiation efficiency of the antenna, improve polarization characteristics, and thus increase the transmission and reception efficiency of a drone or a flight vehicle with a rotator.

Additional advantages, objects, and features of the present disclosure will be set forth in part in the description which follows and in part will become apparent to those having ordinary skill in the art upon examination of the following or may be learned from practice of the present disclosure. The objectives and other advantages of the present disclosure may be realized and attained by the structure particularly pointed out in the written description and claims hereof as well as the appended drawings.

Technical Solution

To achieve these objects and other advantages and in accordance with the purpose of the present disclosure, as embodied and broadly described herein, an omni-directional antenna using a rotator, which is installed on the rotator having at least one rotation blade, includes an antenna carrier unit disposed on at least one of top and bottom surfaces of the blade, and an antenna pattern unit formed on the antenna carrier unit.

As the antenna pattern unit rotates along with the blade by operation of the rotator, the antenna pattern unit may form a circular virtual pattern having a radius within which a signal is transmitted and received.

The antenna carrier unit may be disposed on the top surface of the blade.

The antenna carrier unit may be disposed on the bottom surface of the blade.

The antenna carrier unit may include a first antenna carrier having the antenna pattern unit formed on the top surface of the blade, and a second antenna carrier having the antenna pattern unit formed on the bottom surface of the blade.

The antenna pattern unit may include a first antenna pattern covering a predetermined part of a top surface of the first antenna carrier, and a second antenna pattern covering a predetermined part of a bottom surface of the second antenna carrier, and connected to the first antenna pattern.

A blade via hole may be formed in the form of a through hole on the blade to connect a portion of the first antenna carrier to a portion of the second antenna carrier, a first antenna via hole may be formed at a position communicating with the blade via hole, at the portion of the first antenna carrier, and a second antenna via hole may be formed at a position communicating with the blade via hole, at the portion of the second antenna carrier, thereby electrically connecting the first antenna pattern to the second antenna pattern through the first antenna via hole, the blade via hole, and the second antenna via hole.

It is to be understood that both the foregoing general description and the following detailed description of the present disclosure are exemplary and explanatory and are intended to provide further explanation of the present disclosure as claimed.

Advantageous Effects

According to an omni-directional antenna using a rotator according to an embodiment of the present disclosure, as an antenna is installed on a rotation blade installed in a rotator with the rotation blade, when the blade rotates, the antenna is rotated along with the blade, thereby making a rotating area serving as a virtual pattern. A change in polarization characteristics caused by the rotation and improvement of the polarization characteristics based on the changed may lead to the increase of the transmission and reception efficiency of the antenna.

Further, since the antenna is installed to the rotation blade and rotates along with the blade in the omni-directional antenna using the rotator according to the present disclosure, the influence on a use environment or a material used for the antenna is minimized, while radiation efficiency and polarization characteristics are maintained. As a consequence, the transmission and reception efficiency of the antenna can be increased.

Particularly, since an aircraft or industrial drone having a rotator has a light body and is formed of a metal robust against an ambient environment, such as aluminum or titanium, it faces degradation of transmission and reception performance and fluctuation in transmission and reception efficiency according to altitudes. If the omni-directional antenna using the rotator according to the present disclosure is adopted, the antenna radiation efficiency and directionality may be increased in spite of the use of the metal, altitudes, and situation changes.

Further, due to installation of the antenna on the rotation blade and rotation of the antenna along with the rotation blade, the omni-directional antenna using the rotator according to the present disclosure achieves omni-directionality close to a circle, thereby increasing radiation directionality.

BRIEF DESCRIPTION OF DRAWINGS

The accompanying drawings, which are included to provide a further understanding of the present disclosure and are incorporated in and constitute a part of this application, illustrate embodiment(s) of the present disclosure and together with the description serve to explain the principle of the present disclosure.

In the drawings.

BEST MODE

Objects, advantages, and technical structures for achieving them will become apparent upon examination of the following detailed description of embodiments of the present disclosure as well as the attached drawings. In the description of the present disclosure, a detailed description of known functions or configurations will be omitted lest it should obscure the subject matter of the present disclosure. The terms as set forth herein are defined in consideration of the structures, roles, and functions of the present disclosure, and may vary according to the intent of a user and an operator, or customs.

However, the present disclosure is not limited to the disclosed embodiments. Rather, the present disclosure may be implemented in various other ways. The embodiments are provided to make the disclosure of the present disclosure comprehensive and help those skilled in the art to comprehensively understand the scope of the present disclosure, and the present disclosure is defined only by the appended claims. Therefore, the definition should be made based on the overall contents of the specification.

With reference to the attached drawings, an omni-directional antenna using the rotator will be described in great detail.

Figure 1:
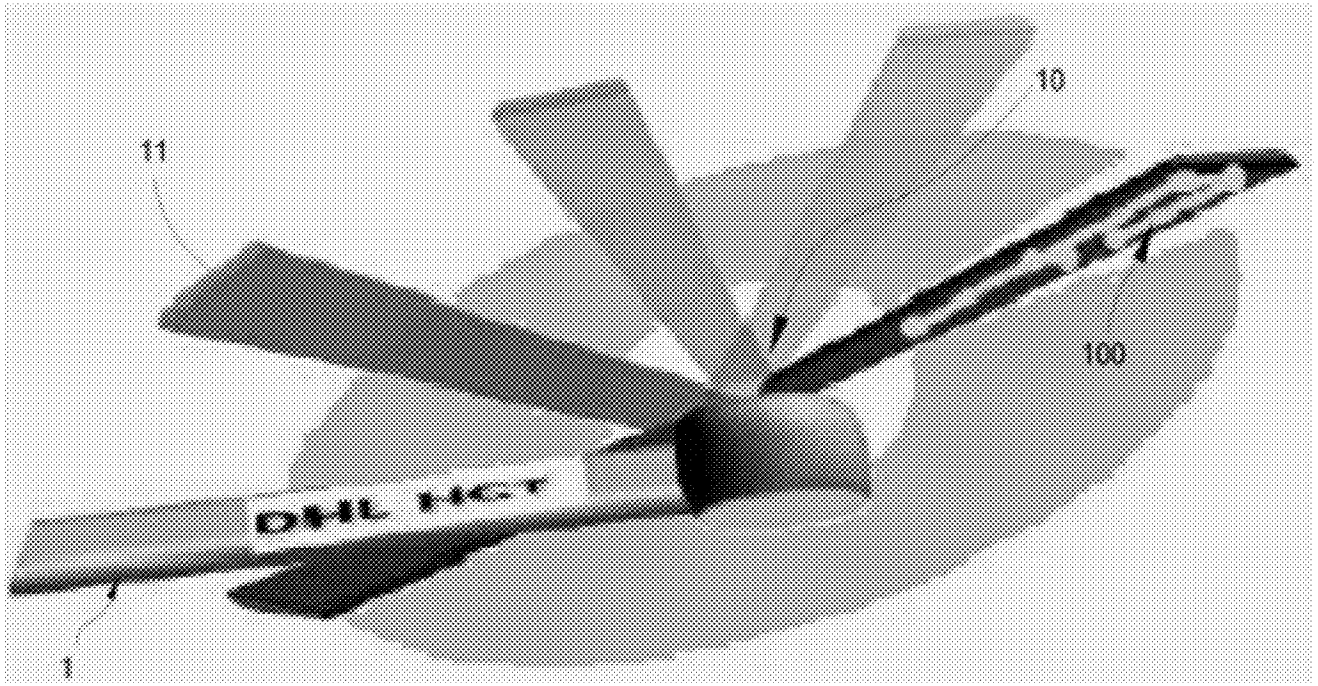
FIG. 1 is a use state diagram illustrating a use state of an omni-directional antenna using a rotator according to an embodiment of the present disclosure.
Figure 2:
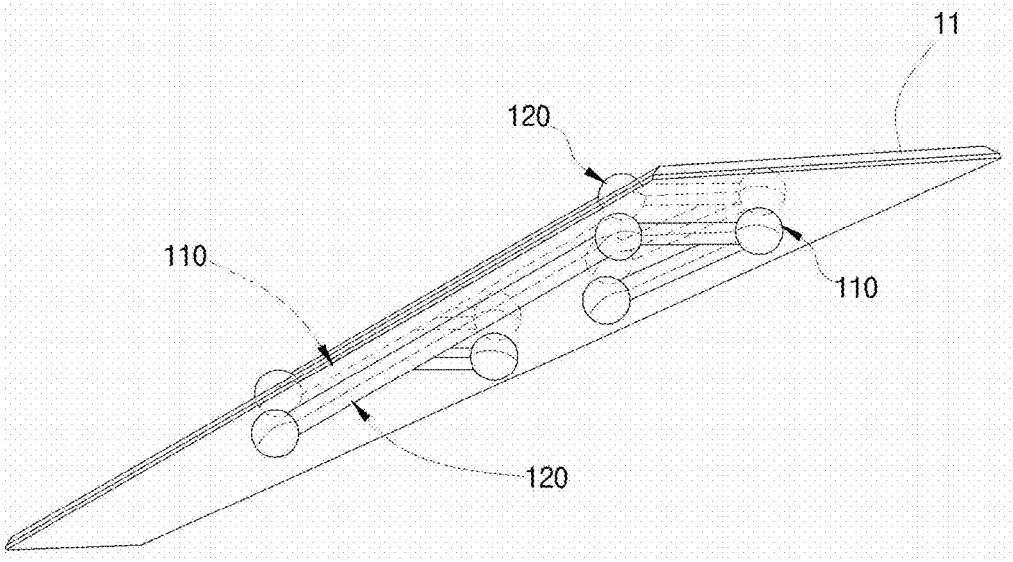
FIG. 2 is a perspective view illustrating the omni-directional antenna using the rotator, illustrated in FIG. 1.
Figure 3:
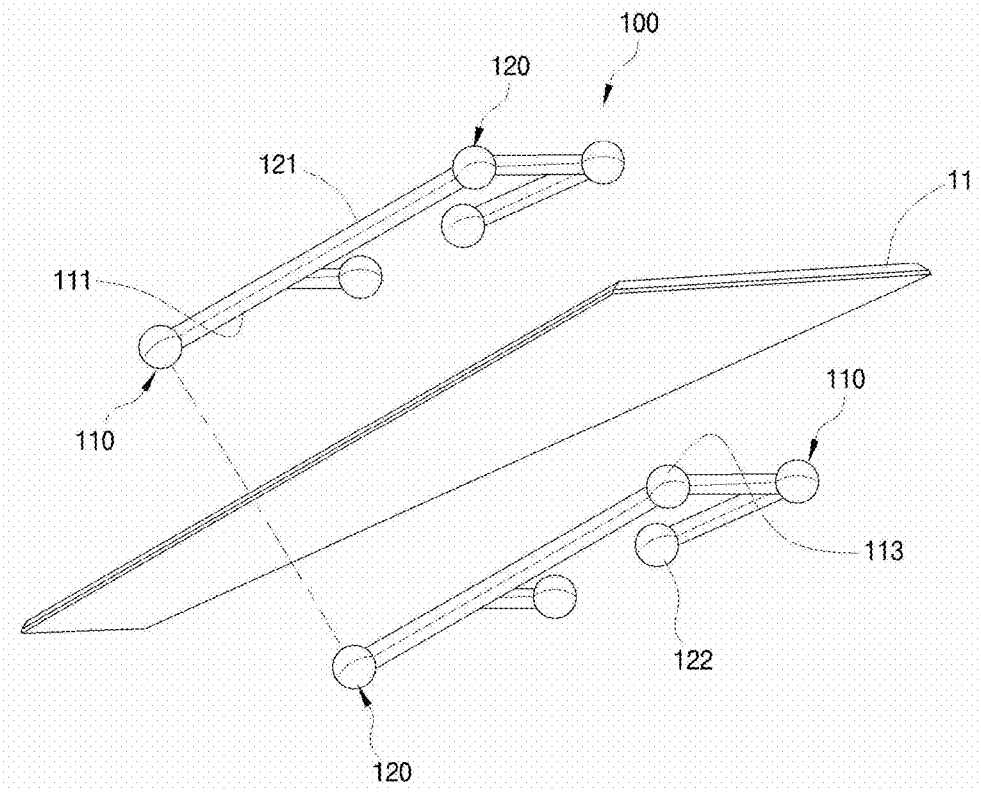
FIG. 3 is an exploded perspective view illustrating the omni-directional antenna using the rotator, illustrated in FIG. 1.

FIG. 1 is a use state diagram illustrating a use state of an omni-directional antenna using a rotator according to an embodiment of the present disclosure, FIG. 2 is a perspective view illustrating the omni-directional antenna using the rotator, illustrated in FIG. 1, and FIG. 3 is an exploded perspective view illustrating the omni-directional antenna using the rotator, illustrated in FIG. 1.

Referring to FIGS. 1, 2 and 3, an omni-directional antenna 100 using a rotator is installed to a blade 11 of a rotator 1 in the form of a propeller which rotates at least one blade by operation of a rotation driver 10. While the rotator 1 is shown in FIG. 1 as a propeller-type drone, for the convenience of description, the rotator 1 may be any of devices rotated with at least one blade 11.

That is, it is apparent to those skilled in the art that the rotator 1 may be any of devices operating by rotation of a propeller, such as a helicopter that generates lift force and thrust force by rotation of the blade 11, an aircraft that separates lift force from thrust force and generates the thrust force by the rotating blade 11, and a wind power plant that generates electricity by rotating a plurality of blades 11 by wind force.

As described above, a drone taken as an example of the rotator 1 is a device that generates lift force and thrust force by operating the rotation driver 10 and thus rotating a plurality of blades 11, and thus takes off, lands, and flies to an intended location. The drone is a kind of unmanned air vehicle used to carry an object, monitor forest fire or natural disaster, capture images, and so on through remote control. The drone is equipped with an antenna for transmitting and receiving multi-band signals in different frequency bands, such as a remote control signal, an image, and a voice.

The drone is formed of a metal such as aluminum or duralumin that reduces the weight of a body of the drone and is robust against an external environment, and suffers from wave interference by rotation of the blades. Accordingly, an omni-directional antenna using a rotator is installed in the drone in order to minimize the influence of wave interference and improve polarization characteristics, thereby increasing the transmission and reception efficiency of a multi-band signal.

The omni-directional antenna 100 using the rotator includes an antenna carrier unit 110 and an antenna pattern unit 120, which are installed to the blade 11 that rotates in the rotator 1.

The antenna carrier unit 110 includes a first antenna carrier 111 disposed on the top surface of the blade 11 and a second antenna carrier 113 disposed on the bottom surface of the blade 11. The first antenna carrier 111 on the top surface of the blade 11 rotates along with the blade 11 by operation of the rotator driver 10. The first antenna carrier 111 is installed such that the antenna pattern unit 120 for transmitting and receiving a multi-band signal may be fixed on the top surface of the blade 11. The first antenna carrier 111 forms an antenna body on the top surface of the rotating blade 11 and is engaged with the blade 11, to thereby prevent deviation of the fixed antenna pattern unit 120 even during rotation.

The second antenna carrier 113 is mounted on the bottom surface of the blade 11 and rotates along with the blade 11 by operation of the rotator driver 10. The second antenna carrier 113 is installed such that the antenna pattern unit 120 for transmitting and receiving a multi-band signal may be fixed on the bottom surface of the blade 11. The second antenna carrier 113 forms an antenna body on the bottom surface of the rotating blade 11 and is engaged with the blade 11, to thereby prevent deviation of the fixed antenna pattern unit 120 even during rotation.

On or both of the above-described first and second antenna carriers 111 and 113 may be installed according to a transmitted/received signal, and the rotation speed and rotation degree of the blade 11 of the rotator 1, by user selection. That is, the first antenna carrier 111 installed on the top surface of the blade 11 and the second antenna carrier 113 installed on the bottom surface of the blade 11 may be selectively installed on the top surface, the bottom surface, or both surfaces of the blade 11 by a user.

The antenna pattern unit 120 includes a first antenna pattern 121 formed on the first antenna carrier 111, and a second antenna pattern 122 formed on the second antenna carrier 113. Herein, the antenna pattern unit 120 is formed on the top and bottom surfaces of the antenna carrier unit 110. The antenna pattern unit 120 may be formed on the surfaces of the antenna carrier unit 110 by, but not limited to, Laser Direct Structure (LDS), Print Direct Structure (PDS), or the like. That is, the antenna pattern unit 120 may be formed on the surfaces of the antenna carrier unit 110 in any available structure by any available scheme.

The first antenna pattern 121 is formed to cover a predetermined part of the top surface of the first antenna carrier 111 mounted on the top surface of the blade 11, so that when the blade 11 rotates, the first antenna pattern 121 may rotate fixed on the first antenna carrier 111, forming a circular virtual pattern along a rotation trace on the top of the blade 11. That is, the first antenna pattern 121 is provided in the form of a pattern for transmitting and receiving wave signals on the top surface of the blade 11, and rotates along with the blade 11, extended to a circular pattern area, when the blade 11 rotates. Time-variant polarization characteristics may be changed due to the rotation, and the resulting improvement of polarization characteristics may increase the transmission and reception efficiency of signals.

The second antenna pattern 122 is formed to cover a predetermined part of the top surface of the second antenna carrier 113 mounted on the bottom surface of the blade 11, so that when the blade 11 rotates, the second antenna pattern 122 may rotate fixed on the second antenna carrier 113, forming a circular virtual pattern along a rotation trace on the bottom of the blade 11. That is, the second antenna pattern 122 is provided in the form of a pattern for transmitting and receiving wave signals on the bottom surface of the blade 11, and rotates along with the blade 11, extended to a circular pattern area, when the blade 11 rotates. Time-variant polarization characteristics may be changed due to the rotation, and the resulting improvement of polarization characteristics may increase the transmission and reception efficiency of signals.

The above-described first and second antenna patterns 121 and 122 are provided to cover predetermined parts of the first and second antenna carriers 111 and 113, respectively. The selectively installed first and second antenna patterns 121 and 122 are provided according to their installation positions.

That is, the first and second antenna patterns 122 are provided on the first and second antenna carriers 111 and 112 selectively installed on the top and bottom surfaces of the blade 11, respectively. As the first and second antenna patterns 121 and 122 are extended according to rotation traces on the top and bottom surfaces of the blade 11 by rotation of the blade 11, radio efficiency may be increased, and time-variant polarization characteristics may be changed due to the rotation. The resulting improvement of polarization characteristics may increase the transmission and reception efficiency of signals.

As described above, the omni-directional antenna 100 using the rotator is configured by installing the first antenna carrier 111 with the first antenna pattern 121 formed thereon on the top surface of the blade 11 and installing the second antenna carrier 113 with the second antenna pattern 122 formed thereon on the bottom surface of the blade 11, such that when the blade 11 rotates, the first and second antenna carriers 111 and 113 may be rotated along with the blade 11. When the blade 11 rotates, the first and second antenna patterns 121 and 122 are rotated, forming circular virtual patterns according to their rotation traces. Due to a change in time-variant polarization characteristics and improvement of polarization characteristics based on the change may lead to the increase of transmission and reception efficiency of signals.

Figure 4:
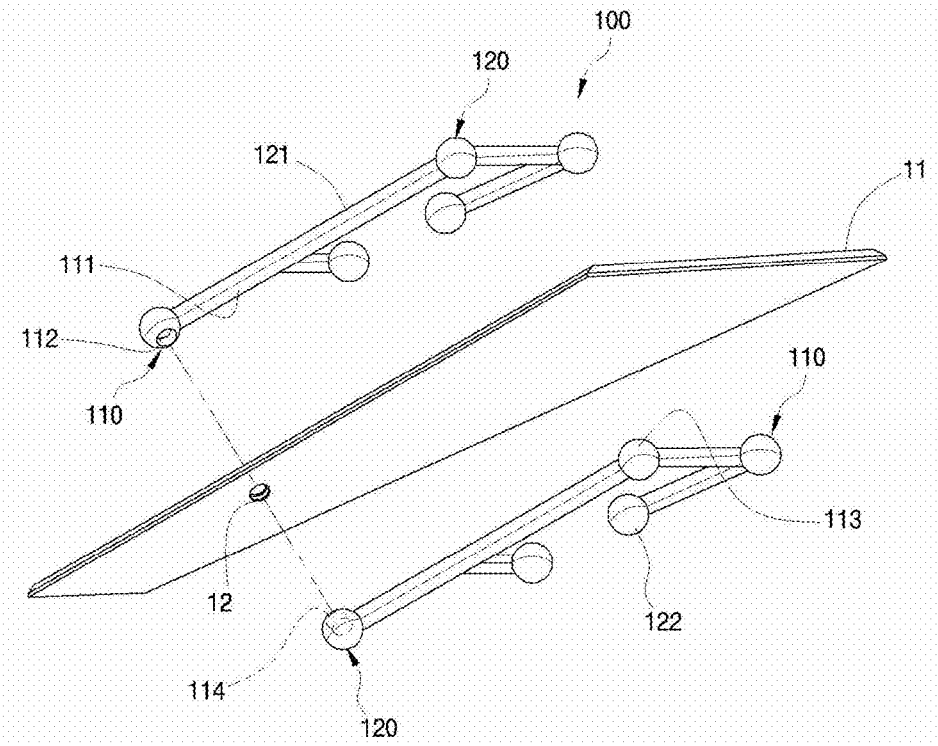
FIG. 4 is an exploded perspective view illustrating an omni-directional antenna using a rotator according to another embodiment of the present disclosure.
Figure 5:
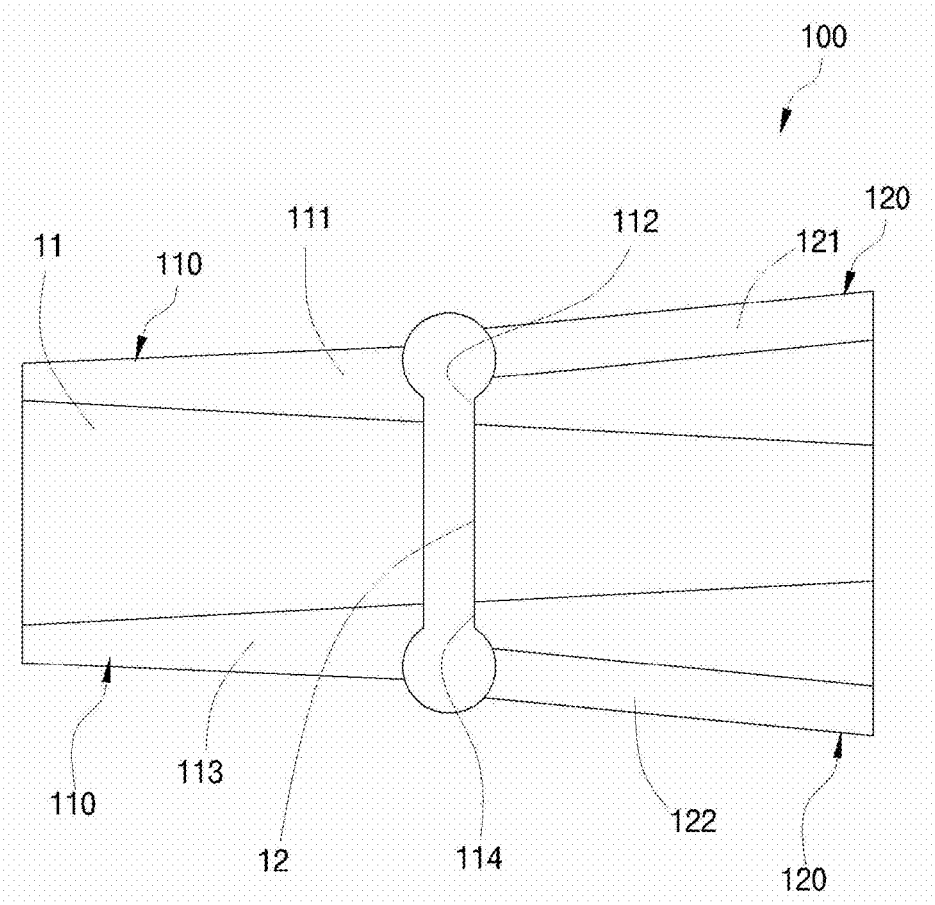
FIG. 5 is a partially-cut sectional view illustrating an installation state of the omni-directional antenna using the rotator, illustrated in FIG. 4.

With reference to FIGS. 4 and 5, an omni-directional antenna using a rotator according to another embodiment of the present disclosure will be described below.

FIG. 4 is an exploded perspective view illustrating an omni-directional antenna using a rotator according to another embodiment of the present disclosure, and FIG. 5 is a partially-cut sectional view illustrating an installation state of the omni-directional antenna using the rotator, illustrated in FIG. 4.

Referring to FIGS. 4 and 5, the omni-directional antenna 100 using a rotator according to another embodiment of the present disclosure includes the antenna carrier unit 110 and the antenna pattern unit 120, which are installed on the blade 11 of the rotator 1. The antenna carrier unit 110 and the antenna pattern unit 120 illustrated in FIGS. 4 and 5 are partially identical to their counterparts in the omni-directional antenna 100 using the rotator, illustrated in FIGS. 1, 2 and 3. Thus, only different configurations will be described below.

A via hole 12 is formed at portions of the first and second antenna carriers 111 and 113 on the blade 11, in the form of a through hole connecting the first and second antenna carriers 111 and 113. The blade via hole 12 is formed in the form of a through hole so that the first and second antenna carriers 111 and 113 on the top and bottom surfaces of the blade 11 may communicate with each other.

Further, a first antenna via hole 112 is formed at a position communicating with the blade via hole 12, in a portion of the first antenna carrier 111. The first antenna via hole 112 is formed in the form of a hole through which the portion of the first antenna pattern 121 formed on the top surface of the first antenna carrier 111 communicates with the blade via hole 12.

A second antenna via hole 114 is formed at a position communicating with the blade via hole 12, in a portion of the second antenna carrier 113. The second antenna via hole 114 is formed in the form of a hole through which the portion of the second antenna pattern 122 formed on the bottom surface of the second antenna carrier 113 communicates with the blade via hole 12.

As described above, as the first antenna via hole 112 is formed above the blade via hole 12 penetrating through the blade 11 and the second antenna via hole 114 is formed under the blade via hole 12, the first antenna pattern 121 may be connected electrically to the second antenna pattern 122 through the first antenna via hole 112, the blade via hole 12, and the second antenna via hole 114.

As described above, since the electrical connection between the first and second antenna patterns 121 and 133 formed respectively on the top and bottom surfaces of the blade 11 enables the increase of the lengths of the patterns, radiation efficiency may be increased by extending the areas of the patterns. Further, the areas of the patterns may be increased during rotation of the blade 11. The resulting minimization of a shadowing area may increase the transmission and reception efficiency of signals.

It will be apparent to those skilled in the art that various modifications and variations can be made in the present disclosure without departing from the spirit or scope of the present disclosure. Thus, it is intended that the present disclosure covers the modifications and variations of this present disclosure provided they come within the scope of the appended claims and their equivalents.

What is claimed is:

1. An omni-directional antenna installed to a rotator having at least one rotation blade, the omni-directional antenna comprising:

a first antenna carrier unit disposed on a top surface of the blade;

a first antenna pattern formed on the first antenna carrier unit;

a second antenna carrier unit disposed on a bottom surface of the blade; and a second antenna pattern formed on the second antenna carrier unit, wherein the omni-directional antenna is non-directional, and as the omni-directional antenna is used on the top and bottom surfaces of the blade, the omni-directional antenna forms omni-directional antenna beams in spaces above and under the blade along with rotation of the blade, wherein a blade via hole is formed in the form of a through hole on the blade to connect a portion of the first antenna carrier to a portion of the second antenna carrier, a first antenna via hole is formed at a position communicating with the blade via hole, at the portion of the first antenna carrier, and a second antenna via hole is formed at a position communicating with the blade via hole, at the portion of the second antenna carrier, thereby electrically connecting the first antenna pattern to the second antenna pattern through the first antenna via hole, the blade via hole, and the second antenna via hole.

2. The omni-directional antenna according to claim 1, wherein the first antenna pattern and the second antenna pattern are rotated along with the blade by operation of the rotator, forming a circular virtual pattern having a radius within which a signal is transmitted and received.

3. An antenna, comprising:

a first antenna carrier disposed on a top surface of a rotational blade of a rotator;

a first antenna pattern formed on the first antenna carrier;

a second antenna carrier disposed on a bottom surface of the rotational blade; and a second antenna pattern formed on the second antenna carrier, wherein the first antenna pattern electrically communicates with the second antenna pattern by way of a through hole which penetrates the rotational blade.

4. The antenna of claim 3, wherein:

the first antenna carrier comprises a first via hole provided at a first portion corresponding to a position of the through hole, the second antenna carrier comprises a second via hole provided at a second portion corresponding to the position of the through hole, and the first antenna pattern electrically communicates with the second antenna pattern by way of the first via hole and the second via hole in addition to the through hole.

5. The antenna of claim 3, wherein:

the antenna is omni-directional.

6. The antenna of claim 3, wherein:

the antenna is non-directional.

7. The antenna of claim 3, wherein:

the antenna is configured to wirelessly communicate with a communication apparatus on the ground.

8. The antenna of claim 3, wherein the first antenna carrier and the second antenna carrier are configured to rotate together with the rotational blade in accordance with a rotation of the rotator.

9. A communication apparatus, comprising:

a rotator; and a plurality of rotational blades physically coupled to the rotator, a first antenna carrier disposed on a top surface of a first rotational blade of the rotator;

a first antenna pattern formed on the first antenna carrier;

a second antenna carrier disposed on a bottom surface of the rotational blade; and a second antenna pattern formed on the second antenna carrier, wherein the first antenna pattern electrically communicates with the second antenna pattern by way of a through hole which penetrates the rotational blade, and at least one of the first antenna pattern and the second antenna pattern is configured to wirelessly communicate with a communication device.

10. The communication apparatus of claim 9, wherein:

the first antenna carrier comprises a first via hole provided at a first portion corresponding to a position of the through hole, the second antenna carrier comprises a second via hole provided at a second portion corresponding to the position of the through hole, and the first antenna pattern electrically communicates with the second antenna pattern by way of the first via hole and the second via hole in addition to the through hole.

11. The communication apparatus of claim 9, wherein:

at least one of the first antenna pattern and the second antenna pattern omni-directionally transmits a signal.

12. The communication apparatus of claim 9, wherein:

at least one of the first antenna pattern and the second antenna pattern non-directionally transmits a signal.

13. The communication apparatus of claim 9, wherein the first antenna carrier and the second antenna carrier are configured to rotate together with the rotational blade.

* * * * *